US010934906B2

(12) United States Patent
Ishikawa

(10) Patent No.: US 10,934,906 B2
(45) Date of Patent: Mar. 2, 2021

(54) BLOW-BY GAS TREATING DEVICE

(71) Applicant: TOYOTA JIDOSHA KABUSHIKI KAISHA, Toyota (JP)

(72) Inventor: Masami Ishikawa, Aichi-ken (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/550,461

(22) Filed: Aug. 26, 2019

(65) Prior Publication Data

US 2020/0102863 A1 Apr. 2, 2020

(30) Foreign Application Priority Data

Sep. 27, 2018 (JP) ..... JP2018-181548

(51) Int. Cl.

| | |
|---|---|
| ***F02M 25/06*** | (2016.01) |
| ***F01M 13/00*** | (2006.01) |
| ***F01M 13/02*** | (2006.01) |
| ***F01M 13/04*** | (2006.01) |
| ***F02M 35/10*** | (2006.01) |

(52) U.S. Cl.

CPC ..... *F01M 13/0011* (2013.01); *F01M 13/028* (2013.01); *F01M 13/04* (2013.01); *F02M 25/06* (2013.01); *F02M 35/10222* (2013.01)

(58) Field of Classification Search

CPC ..... F02M 25/06; F02M 35/10222; F01M 13/011; F01M 13/028; F01M 13/04; F01M 2013/0038; F01M 13/021; F01M 13/022; F01M 13/023; F01M 2013/027

See application file for complete search history.

(56) References Cited

U.S. PATENT DOCUMENTS

| | | | | |
|---|---|---|---|---|
| 3,766,898 | A * | 10/1973 | McMullen | F01M 13/023 123/574 |
| 4,667,647 | A * | 5/1987 | Ohtaka | F01M 5/001 123/573 |
| 2002/0062869 | A1* | 5/2002 | Toyokawa | F16L 41/088 137/515 |
| 2011/0203559 | A1* | 8/2011 | Tanikawa | F02M 25/06 123/572 |
| 2012/0006306 | A1* | 1/2012 | Boehm | F01M 13/0011 123/572 |

(Continued)

FOREIGN PATENT DOCUMENTS

| | | |
|---|---|---|
| JP | 2000-110538 A | 4/2000 |
| JP | 2003-097244 A | 4/2003 |
| JP | 2009-150289 A | 7/2009 |

*Primary Examiner* — Jacob M Amick
(74) *Attorney, Agent, or Firm* — Oliff PLC

(57) ABSTRACT

A blow-by gas treating device has an oil separator. A tubular attachment portion is disposed at a discharge port of the oil separator. A PCV valve is inserted in the attachment portion. The PCV valve includes an inflow hole, a discharge hole, a flow rate regulating portion, and a stopping portion. The stopping portion is located closer to the inflow hole than to the flow rate regulating portion. The stopping portion has a dimension greater than the inner diameter of the attachment portion in a direction perpendicular to the central axis of the attachment portion. The flow rate regulating portion is surrounded by the attachment portion. The stopping portion is arranged in the space defined by the oil separator.

7 Claims, 3 Drawing Sheets

(56) References Cited

U.S. PATENT DOCUMENTS

| | | | | |
|---|---|---|---|---|
| 2014/0174415 | A1* | 6/2014 | Murakami | F01M 13/0405 123/574 |
| 2016/0333755 | A1* | 11/2016 | Kira | B01D 46/0031 |
| 2017/0370256 | A1* | 12/2017 | Tokunaga | F01P 3/12 |

* cited by examiner

BLOW-BY GAS TREATING DEVICE

BACKGROUND

1. Field

The present disclosure relates to a blow-by gas treating device.

2. Description of Related Art

Internal combustion engines including a blow-by gas treating device have been known. A blow-by gas treating device includes a blow-by gas passage, a PCV valve, and an oil separator. Blow-by gas leaking from the combustion chamber into the crankcase of an engine is introduced into the intake passage via the blow-by gas passage. The PCV valve selectively opens and closes the blow-by gas passage. The oil separator separates oil from blow-by gas. Japanese Laid-Open Patent Publication No. 2000-110538 discloses a PCV valve attached to an oil separator. A tubular attachment portion is provided on the outer surface of the oil separator. A stopping hole is provided in the PCV valve and a stopping claw portion is provided on the tubular attachment portion. The stopping claw portion is engaged with the edge of the engagement hole to fix the PCV valve to the oil separator. A hose is connected to the PCV valve to introduce blow-by gas into the intake passage.

When a vehicle having an internal combustion engine vibrates and shakes the hose connected to the PCV valve, which is attached to the oil separator, stress may be applied to the PCV valve. If the PCV valve is fixed to the oil separator by engaging the PCV valve with the tubular attachment portion, as described in Japanese Laid-Open Patent Publication No. 2000-110538, the stress applied to the PCV valve may separate the PCV valve from the oil separator. Even if such separation of the PCV valve does not occur, the stress may deform the PCV valve, thus hampering the function of the blow-by gas treating device.

SUMMARY

In one general aspect, a blow-by gas treating device is provided that includes an oil separator that separates oil from blow-by gas, a connecting pipe that connects the oil separator to an intake passage of an internal combustion engine, a PCV valve that selectively opens and closes the connecting pipe, and a blow-by gas passage that releases blow-by gas from inside a crankcase to the intake passage. The oil separator has a discharge port as an outlet port for the blow-by gas. A tubular attachment portion in which the PCV valve is inserted is disposed at the discharge port. The PCV valve includes an inflow hole into which the blow-by gas flows, a discharge hole from which the blow-by gas is discharged, a flow rate regulating portion having a cross-sectional flow area that is changed through movement of a valve member, and a stopping portion located closer to the inflow hole than to the flow rate regulating portion. The stopping portion has a dimension greater than an inner diameter of the attachment portion in a direction perpendicular to a central axis of the attachment portion. The flow rate regulating portion is surrounded by the attachment portion. An end of the connecting pipe corresponding to the oil separator is attached to a section of the PCV valve between the flow rate regulating portion and the discharge hole. The stopping portion is arranged in a space defined by the oil separator.

In the above-described configuration, the stopping portion has the dimension greater than the inner diameter of the attachment portion and thus cannot pass through the attachment portion. The stopping portion is arranged in the space defined by the oil separator. This restricts movement of the PCV valve in a direction outward with respect to the oil separator even if stress is applied to the PCV valve. As a result, the PCV valve is unlikely to separate from the attachment portion.

Also, in the configuration, the flow rate regulating portion is located at a position where the flow rate regulating portion is surrounded by the attachment portion and thus unlikely to be deformed. This limits deformation of the flow rate regulating portion.

Therefore, the configuration makes it unlikely that the blow-by gas passage will open due to separation of the PCV valve from the oil separator, while limiting deformation of the flow rate regulating portion and thus maintaining the function of the PCV valve. That is, the configuration limits hampering of the function of the blow-by gas treating device.

In the above-described blow-by gas treating device, the flow rate regulating portion may be surrounded by the attachment portion from one end to the other in the direction along the central axis of the attachment portion.

In the above-described configuration, the flow rate regulating portion is entirely surrounded by the attachment portion. The attachment portion thus covers the flow rate regulating portion, limiting deformation of the flow rate regulating portion as a whole. This facilitates maintaining the function of the PCV valve.

In the above-described blow-by gas treating device, the PCV valve may be fastened to the attachment portion, and the stopping portion may contact an inner wall of the oil separator.

The above-described configuration hampers movement of the PCV valve outward with respect to the oil separator with improved effectiveness, thus preventing separation of the PCV valve from the attachment portion. That is, the configuration makes it unlikely that the blow-by gas passage will open due to separation of the PCV valve from the oil separator, thus limiting communication between the crankcase and the atmospheric air.

In the above-described blow-by gas treating device, the section of the PCV valve between the flow rate regulating portion and the discharge hole may have a dimension smaller than the inner diameter of the attachment portion in the direction perpendicular to the central axis of the attachment portion.

In the above-described configuration, to attach the PCV valve to the oil separator, the PCV valve is inserted into the attachment portion through the space defined by the oil separator.

In the above-described blow-by gas treating device, the PCV valve may be configured by combining a first unit that has the flow rate regulating portion and accommodates the valve member with a second unit to which the connecting pipe is attached.

In the above-described configuration, the PCV valve is configured by combining the first unit with the second unit. This facilitates separation of the PCV valve into the first unit and the second unit when stress is applied to the PCV valve. The deformation of the PCV valve, particularly, the flow rate regulating portion, is thus unlikely to happen. Also, even when external stress is applied to the PCV valve and causes separation of the second unit, to which the connecting pipe is attached, from the first unit, which has the flow rate regulating portion and accommodates the valve member, the first unit limits leakage of blow-by gas from the discharge port of the oil separator. That is, the communication between the crankcase and the atmospheric air is limited.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A blow-by gas treating device 30 according to an embodiment will now be described with reference to FIGS. 1 to 4.

Figure 1:
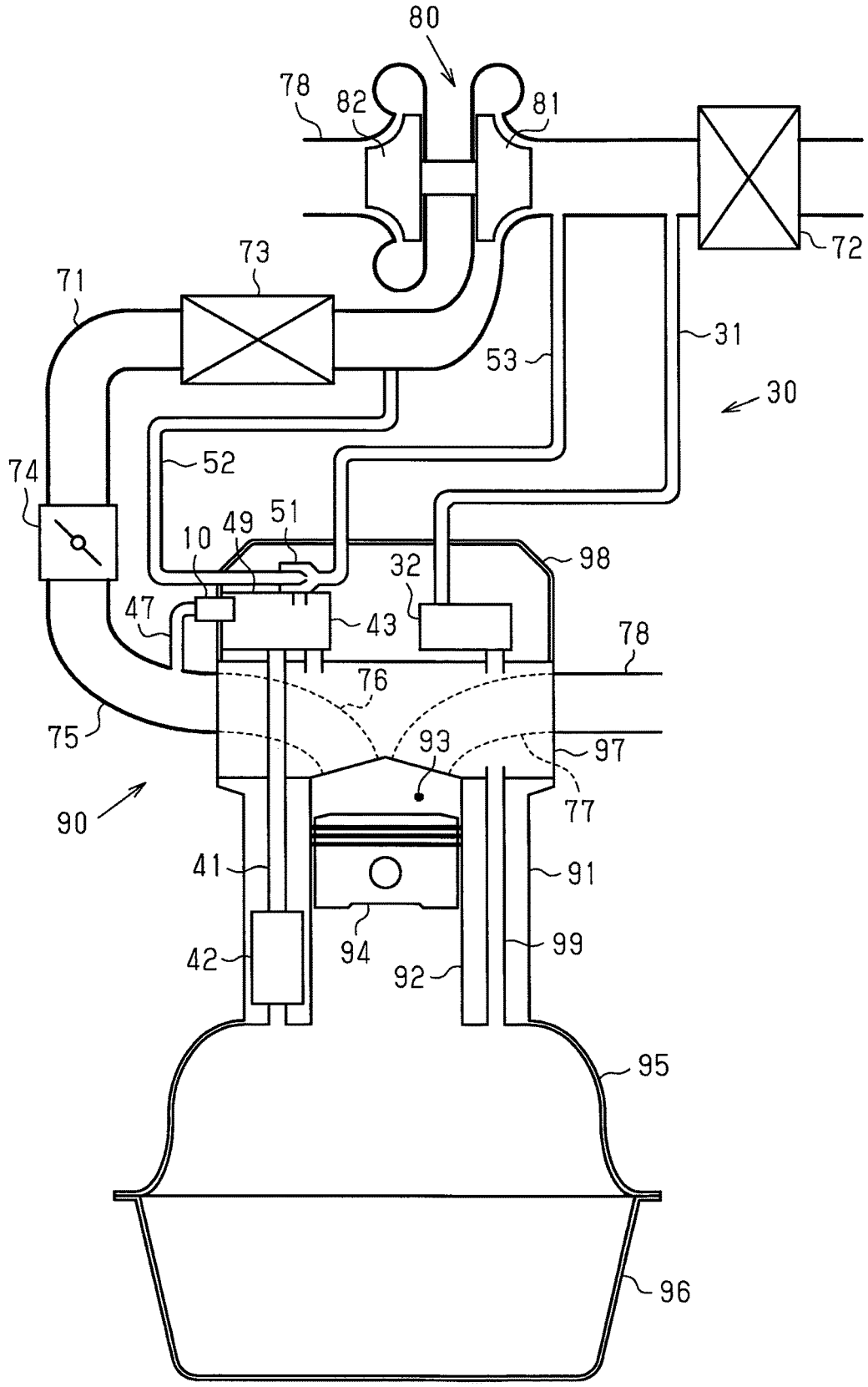
FIG. 1 is a schematic diagram showing an internal combustion engine including a blow-by gas treating device according to an embodiment.

FIG. 1 shows an internal combustion engine 90 equipped with the blow-by gas treating device 30.

The engine 90 includes a cylinder block 91, a cylinder head 97, a head cover 98, a crankcase 95, and an oil pan 96.

The cylinder block 91 includes cylinders 92. A piston 94 is accommodated in each cylinder 92 and capable of reciprocating as a crankshaft accommodated in the crankcase 95 rotates. The engine 90 is a multi-cylinder internal combustion engine including multiple cylinders 92.

The cylinder head 97 has intake valves and exhaust valves of the engine 90. The head cover 98 is attached to the cylinder head 97 and covers camshafts each driving the corresponding intake and exhaust valves.

The oil pan 96 retains oil used to lubricate components of the engine 90 and operate hydraulic mechanisms.

The engine 90 includes a combustion chamber 93, an intake passage 71, and an exhaust passage 78. The combustion chamber 93 is defined by the cylinder 92, the piston 94, and the cylinder head 97. The intake passage 71 introduces intake air into the combustion chamber 93. The exhaust passage 78 discharges, as exhaust gas, air-fuel mixture that has been burned in the combustion chamber 93.

The engine 90 includes an exhaust turbine type forced-induction device 80. A turbine 82 of the forced-induction device 80 is arranged in the exhaust passage 78. A compressor 81 is coupled to the turbine 82 in an integrally rotational manner and arranged in the intake passage 71.

An air cleaner 72 is disposed upstream of the compressor 81 in the intake passage 71 of the engine 90. An intercooler 73 is disposed downstream of the compressor 81. A throttle valve 74 is disposed downstream of the intercooler 73. An intake manifold 75 is disposed downstream of the throttle valve 74 and connected to the cylinder head 97.

Intake air passes through the intake manifold 75 and is introduced into the combustion chamber 93 through an intake port 76 provided in the cylinder head 97. An exhaust port 77 is provided in the cylinder head 97 and discharges exhaust gas from the combustion chamber 93. The exhaust gas is then discharged into the exhaust passage 78 through the exhaust port 77.

The blow-by gas treating device 30 of the engine 90 includes a blow-by gas passage 49 joining the crankcase 95 to the intake passage 71. Blow-by gas leaking from the combustion chamber 93 into the crankcase 95 is introduced into the intake passage 71 by the blow-by gas treating device 30.

The blow-by gas treating device 30 has an oil separator 43 in the blow-by gas passage 49. The oil separator 43 separates oil from blow-by gas. The oil separator 43 is provided in the head cover 98. The oil separator 43 is connected to the intake manifold 75 of the intake passage 71 through a connecting pipe 47. The connecting pipe 47 may be a hose or a plastic pipe. A PCV valve 10 is attached to the oil separator 43. An end of the connecting pipe 47 corresponding to the oil separator 43 is connected to the PCV valve 10. When the pressure in the intake manifold 75 is lower than the pressure in the oil separator 43, the PCV valve 10 opens to connect the oil separator 43 to the intake manifold 75. In the present embodiment, a section of the outer wall of the head cover 98 configures a wall that separates the space defined by the oil separator 43 from the external space of the oil separator 43. That is, the PCV valve 10 is attached to a section of the head cover 98.

The blow-by gas treating device 30 includes a suction passage 41 configured to introduce blow-by gas from the crankcase 95 into the oil separator 43. The suction passage 41 is provided in the cylinder block 91 and the cylinder head 97. A pre-separator 42 is disposed in the suction passage 41 to separate oil from the blow-by gas passing through the suction passage 41.

The blow-by gas treating device 30 includes a fresh-air introducing passage 31 that introduces fresh air from the intake passage 71 into the crankcase 95. One end of the fresh-air introducing passage 31 is connected to a section of the intake passage 71 between the air cleaner 72 and the compressor 81. The other end of the fresh-air introducing passage 31 is connected to an atmosphere-side separator 32 provided in the head cover 98.

A communicating line 99 is provided in the cylinder block 91 and communicates with the crankcase 95. The intake passage 71 is connected to the crankcase 95 through the fresh-air introducing passage 31, the atmosphere-side separator 32, and the communicating line 99.

The blow-by gas treating device 30 includes an ejector 51. The ejector 51 produces negative pressure when the forced-induction device 80 is driven. The ejector 51 is connected to the oil separator 43. A first intake-air circulating line 52 and a second intake-air circulating line 53 are connected to the ejector 51. The first intake-air circulating line 52 is connected to a section of the intake passage 71 between the compressor 81 and the intercooler 73. The second intake-air circulating line 53 is connected to a section of the intake passage 71 between the air cleaner 72 and the compressor 81. The connecting portion between the second intake-air circulating line 53 and the intake passage 71 is located downstream of the connecting portion between the fresh-air introducing passage 31 and the intake passage 71.

When the engine 90 is operated not in the forced-induction range and the pressure in the intake manifold 75 is lower than the pressure in the oil separator 43, the PCV valve 10 opens and thus introduces blow-by gas from the oil separator 43 into the intake passage 71. At this time, the blow-by gas in the crankcase 95 is drawn into the oil separator 43 via the suction passage 41. Also, intake air is drawn from the intake passage 71 into the crankcase 95 via the fresh-air introducing passage 31, the atmosphere-side separator 32, and the communicating line 99.

When the engine 90 is operated in the forced-induction range, the difference in intake-air pressure between an upstream position and a downstream position in the compressor 81 causes the intake air flowing from downstream of the compressor 81 in the intake passage 71 into the first intake-air circulating line 52 to return upstream of the compressor 81 via the ejector 51 and the second intake-air circulating line 53. This produces negative pressure in the ejector 51. At this time, the ejector 51 draws in blow-by gas from inside the crankcase 95 through the oil separator 43 and releases the blow-by gas into the intake passage 71 via the second intake-air circulating line 53. Also, at this time, the blow-by gas in the crankcase 95 flows into the intake passage 71 via the communicating line 99, the atmosphere-side separator 32, and the fresh-air introducing passage 31.

The PCV valve 10 will now be described with reference to FIGS. 2 to 4.

Figure 2:
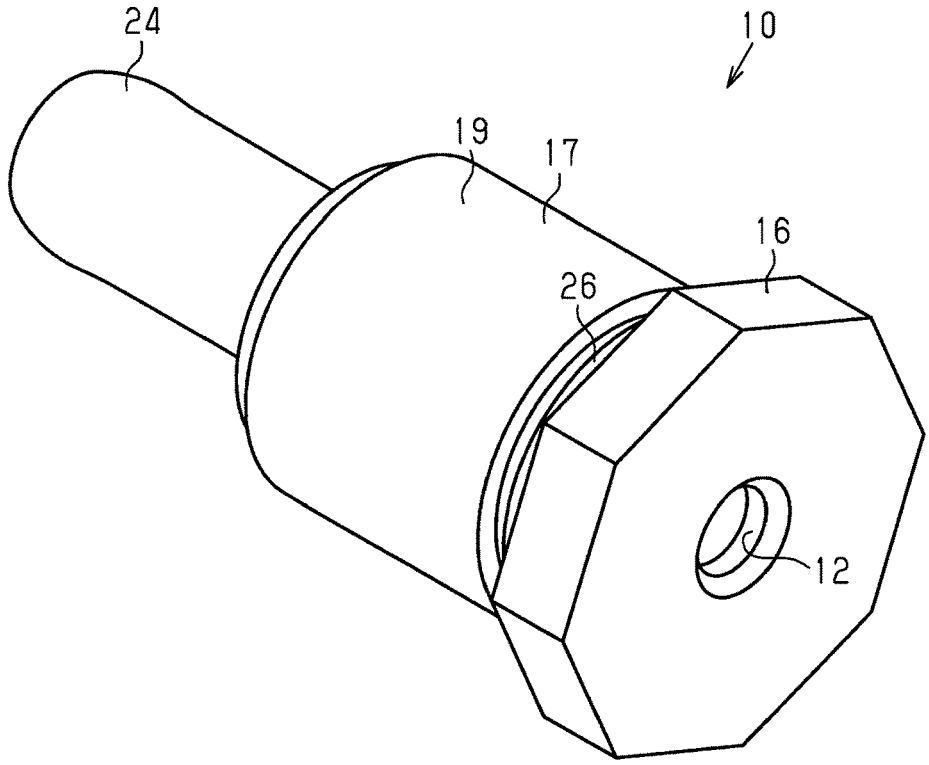
FIG. 2 is a perspective view showing a PCV valve of the blow-by gas treating device of the embodiment.

As shown in FIG. 2, the PCV valve 10 includes an inflow hole 12 to introduce blow-by gas into the PCV valve 10. The PCV valve 10 includes a stopping portion 16 at the end in which the inflow hole 12 opens. The stopping portion 16 has a shape of a regular octagonal prism with the inflow hole 12 extending through the center.

Figure 3:
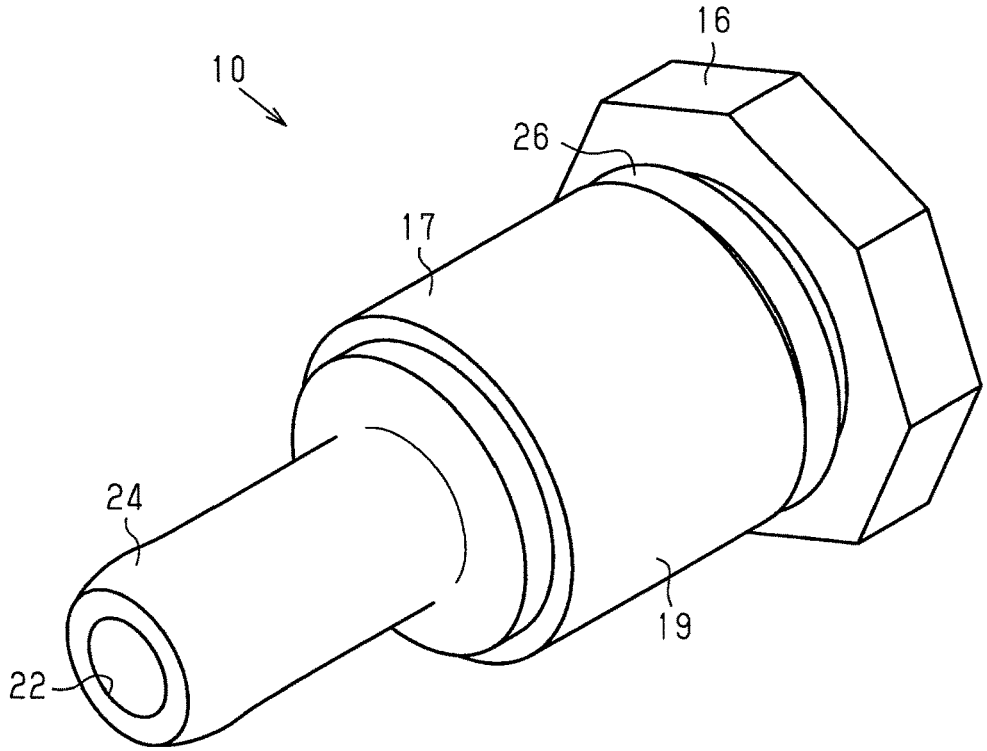
FIG. 3 is a perspective view showing the PCV valve of the blow-by gas treating device of the embodiment.

As illustrated in FIG. 3, the PCV valve 10 includes a discharge hole 22 from which blow-by gas is discharged. A section of the PCV valve 10 closer to the discharge hole 22 than the stopping portion 16 has a cylindrical shape. The PCV valve 10 includes a cylindrical hose connecting portion 24. The discharge hole 22 extends through the hose connecting portion 24.

With reference to FIGS. 2 and 3, the PCV valve 10 has a housing 19 and an O-ring 26 attached to the housing 19. The section of the housing 19 between the O-ring 26 and the distal end of the housing 19 has an external thread portion 17. The external thread portion 17 has an external thread by which the PCV valve 10 is fastened to the oil separator 43.

Figure 4:
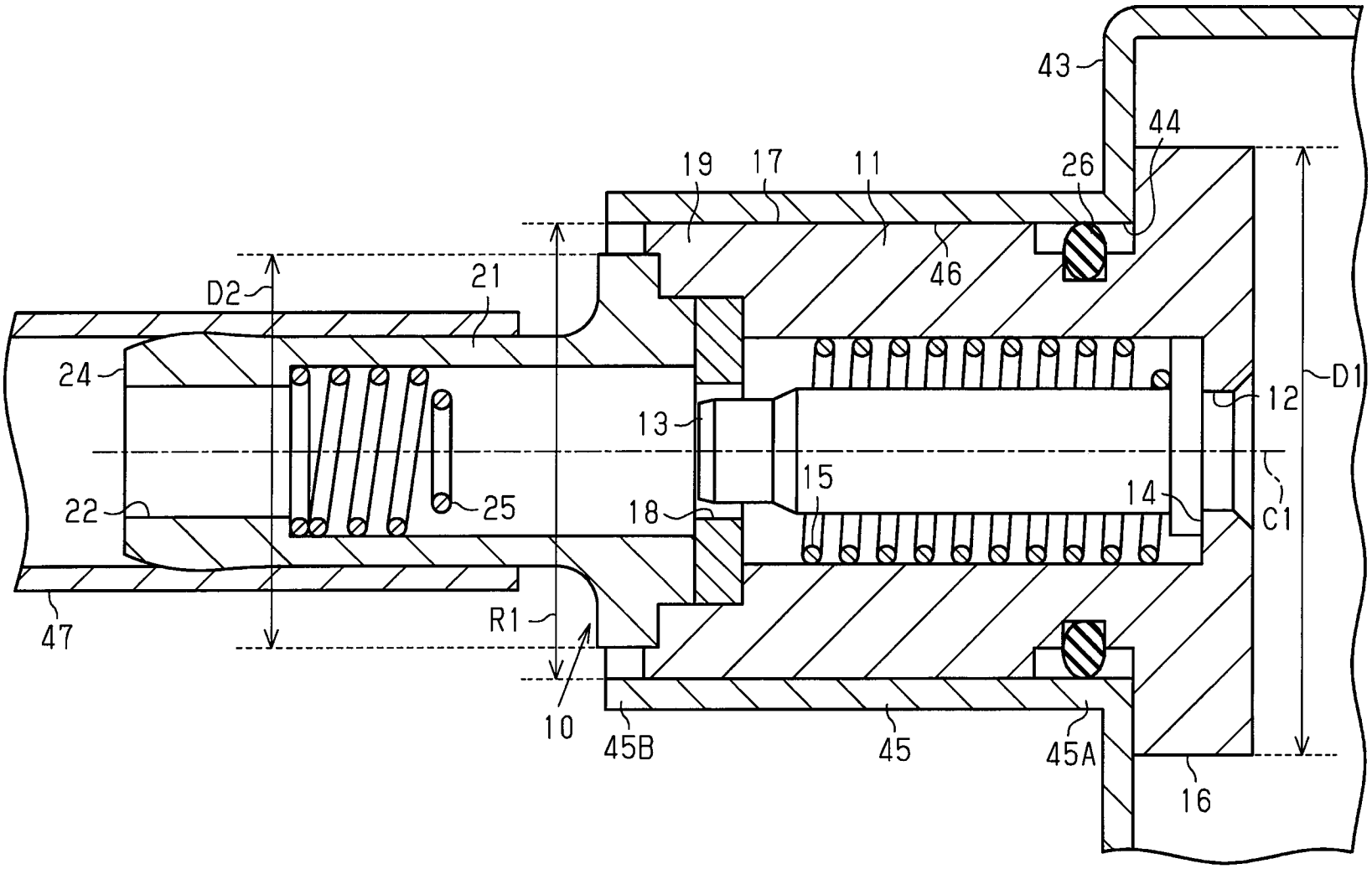
FIG. 4 is a cross-sectional view showing the PCV valve attached to an oil separator of the blow-by gas treating device of the embodiment.

FIG. 4 shows the PCV valve 10 attached to the oil separator 43.

A discharge port 44 opens in the oil separator 43 as an outlet port for blow-by gas. A cylindrical attachment portion 45 is provided in the discharge port 44 of the oil separator 43. The attachment portion 45 extends from the outer wall of the oil separator 43 with the outer wall serving as the proximal end of the attachment portion 45. The inside of the attachment portion 45 communicates with the space defined by the oil separator 43 through the discharge port 44. Hereinafter, the end of the cylindrical attachment portion 45 closer to the oil separator 43 will be referred to as a proximal end 45A, and the end opposite to the proximal end 45A will be referred to as a distal end 45B. The inner diameter of the attachment portion 45 is uniform from the proximal end 45A to the distal end 45B.

The PCV valve 10 is inserted in the attachment portion 45. The hose connecting portion 24 of the PCV valve 10 is inserted in the connecting pipe 47. In FIG. 4, the central axis of the attachment portion 45 is represented as an axis C1. The axis C1 coincides with the line connecting the center of the inflow hole 12 to the center of the discharge hole 22 in the PCV valve 10.

The housing 19 of the PCV valve 10 is configured by combining a first unit 11 with a second unit 21. The stopping portion 16 is provided in the first unit 11. The external thread portion 17 is provided in the outer peripheral surface of the first unit 11. The hose connecting portion 24 is provided in the second unit 21.

The first unit 11 accommodates a valve member 13 movable in the extending direction of the axis C1. The valve member 13 has a shape of a circular column elongated in the extending direction of the axis C1. The diameter of the valve member 13 becomes smaller toward the discharge hole 22. The first unit 11 includes a valve seat 14. The valve member 13 can be seated on the valve seat 14, thus closing the inflow hole 12.

The first unit 11 has a first spring 15 to urge the valve member 13 toward the valve seat 14. When force exceeding the urging force of the first spring 15 is generated, the valve member 13 is separated from the valve seat 14 to open the inflow hole 12.

The first unit 11 has a flow rate regulating portion 18. The flow rate regulating portion 18 has an annular shape such that the valve member 13 can pass through the interior of the flow rate regulating portion 18. The flow rate regulating portion 18 functions as a restrictor of the flow path from the inflow hole 12 to the discharge hole 22. The valve member 13, which has a diameter becoming smaller toward the discharge hole 22, moves in the extending direction of the axis C1. The valve member 13 passes through the flow rate regulating portion 18, thus changing the cross-sectional flow area as the area of the clearance between the flow rate regulating portion 18 and the valve member 13. This regulates the flow rate of the blow-by gas passing through the PCV valve 10.

The second unit 21 is assembled with the end of the first unit 11 closer to the discharge hole 22. The second unit 21 has a second spring 25 to restrict movement of the valve member 13 toward the discharge hole 22.

In FIG. 4, the inner diameter of the attachment portion 45 is represented as R1. The dimension of the stopping portion 16 in a direction perpendicular to the axis C1 is represented as a width D1. The width D1 is defined as the dimension of the section of the stopping portion 16 that has the maximum dimension in the direction perpendicular to the axis C1. The width D1 of the stopping portion 16 is greater than the inner diameter R1. That is, the stopping portion 16 is provided at the end of the PCV valve 10 closer to the inflow hole 12 and has a shape that cannot be inserted into the attachment portion 45. The section of the PCV valve 10 between the flow rate regulating portion 18 and the discharge hole 22, that is, the second unit 21, has a dimension smaller than the inner diameter R1 in the direction perpendicular to the axis C1. Specifically, if the dimension of the section of the second unit 21 having the maximum diameter in the direction perpendicular to the axis C1 is defined as the width D2 as represented in FIG. 4, the second unit 21 is configured such that the width D2 is smaller than the inner diameter R1. Since the maximum outer diameter of the second unit 21 is equal to the width D2, the outer diameter of the hose connecting portion 24 is smaller than the width D2.

In the PCV valve 10 attached to the oil separator 43, the internal thread portion 46 of the attachment portion 45 is threaded onto the external thread portion 17 of the housing 19, thus fastening the PCV valve 10 to the attachment portion 45. The O-ring 26 is attached to the housing 19 and seals the gap between the outer peripheral surface of the housing 19 and the inner peripheral surface of the attachment portion 45.

The stopping portion 16 of the PCV valve 10 is arranged in the space defined by the oil separator 43. The surface of the stopping portion 16 closer to the discharge hole 22 is in surface-contact with an inner surface of the oil separator 43. As shown in FIG. 4, when the valve member 13 is seated on the valve seat 14, the end of the valve member 13 closer to the discharge hole 22, that is, the distal end, is located between the proximal end 45A and the distal end 45B of the attachment portion 45. The flow rate regulating portion 18 is also located between the proximal end 45A and the distal end 45B of the attachment portion 45. In other words, the flow rate regulating portion 18 is surrounded by the attachment portion 45 from one end to the other in the direction along the central axis of the attachment portion. That is, the circumference of the flow rate regulating portion 18 is entirely covered with the attachment portion 45.

Subsequently, a method of attaching the PCV valve 10 to the oil separator 43 will be described. First, the hose connecting portion 24 of the PCV valve 10 is inserted into the attachment portion 45 from inside the oil separator 43, that is, through the space defined by the oil separator 43. Next, the external thread portion 17 of the PCV valve 10 and the internal thread portion 46 of the attachment portion 45 are threaded together to fasten the PCV valve 10 to the attachment portion 45. At this time, the PCV valve 10 is fastened to the attachment portion 45 such that the stopping portion 16 contacts the inner wall of the oil separator 43.

The operation and advantages of the present embodiment will now be described.

In the blow-by gas treating device 30 of the present embodiment, the stopping portion 16 has a dimension greater than the inner diameter of the attachment portion 45 and cannot pass through the attachment portion 45. The stopping portion 16 is arranged in the space defined by the oil separator 43 and contacts the inner wall of the oil separator 43. In this state, the PCV valve 10 is fastened to the attachment portion 45. Therefore, even if stress is applied to the PCV valve 10, movement of the PCV valve 10 outward with respect to the oil separator 43 is restricted. As a result, the PCV valve 10 is unlikely to separate from the attachment portion 45.

The circumference of the flow rate regulating portion 18 is entirely surrounded by the attachment portion 45. The flow rate regulating portion 18 is thus located at a position where the flow rate regulating portion 18 is covered by the attachment portion 45 and thus unlikely to be deformed. That is, deformation of the flow rate regulating portion 18 is limited. This facilitates maintaining the function of the PCV valve 10.

As has been described, the present embodiment limits the opening of the blow-by gas passage 49 due to separation of the PCV valve 10 from the oil separator 43. The embodiment also limits deformation of the flow rate regulating portion 18, thus maintaining the function of the PCV valve 10. That is, the function of the blow-by gas treating device 30 is unlikely to be hampered.

In the present embodiment, the stopping portion 16 is in surface-contact with a wall of the oil separator 43. As a result, the load caused by stress applied to the PCV valve 10 tends to be dispersed in the oil separator 43. This prevents separation and deformation of the PCV valve 10.

In the present embodiment, the PCV valve 10 is configured by combining the first unit 11 with the second unit 21. This facilitates separation of the PCV valve 10 into the first unit 11 and the second unit 21 when stress is applied to the PCV valve 10. As a result, even if stress of an intensity that may deform the flow rate regulating portion 18 is applied, the first unit 11 and the second unit 21 separate from each other and thus limit deformation of the flow rate regulating portion 18. Also, even when external stress is applied to the PCV valve 10 and causes separation of the second unit 21, to which the connecting pipe 47 is attached, from the first unit 11, which has the flow rate regulating portion 18 and accommodates the valve member 13, the first unit 11 limits leakage of blow-by gas from the discharge port 44 of the oil separator 43. That is, the communication between the crankcase 95 and the atmospheric air is limited.

If the connecting pipe 47 separates from the PCV valve 10 and thus opens the path between the intake passage 71 and the PCV valve 10 in the blow-by gas passage 49, the atmospheric air is drawn into the intake passage 71 and thus causes a shift in the operating state of the engine 90. The opening of the blow-by gas passage 49 is thus detected based on the aforementioned shift. However, if the PCV valve 10 separates from the oil separator 43 and thus opens the blow-by gas passage 49 with the PCV valve 10 connected to the intake passage 71 and the connecting pipe 47, the PCV valve 10 hampers suction of air into the intake passage 71 through the connecting pipe 47. The operating state of the engine 90 is thus not changed and the opening of the blow-by gas passage 49 is undetectable. However, in the present embodiment, since the blow-by gas treating device 30 makes it unlikely that the PCV valve 10 will separate from the attachment portion 45, the blow-by gas passage 49 is unlikely to open in a state in which the opening is undetectable.

The PCV valve 10 of the present embodiment has a dimension smaller than the inner diameter of the attachment portion 45 in the section between the flow rate regulating portion 18 and the discharge hole 22 in the direction perpendicular to the axis C1. As a result, when attaching the PCV valve 10 to the oil separator 43, the PCV valve 10 is inserted into the attachment portion 45 through the space defined by the oil separator 43.

The stopping portion 16 of the PCV valve 10 has a shape of a regular octagonal prism. As a result, a tool is readily engaged with the stopping portion 16 when attaching the PCV valve 10 to the attachment portion 45. This facilitates the attachment of the PCV valve 10.

The above described embodiment may be modified as follows. The above-described embodiments and the following modifications can be combined as long as the combined modifications remain technically consistent with each other.

Although the housing 19 of the PCV valve 10 is configured by combining the first unit 11 with the second unit 21 in the above-described embodiment, the housing 19 may be an integrally molded body.

The above-described embodiment describes, by way of example, a fastening structure in which the PCV valve 10 is fixed to the attachment portion 45 by threading the internal thread portion 46 onto the external thread portion 17. However, instead of using the internal thread portion 46 and the external thread portion 17, a fastening tool such as a clamp or band may be used to fasten the PCV valve 10 from outside the attachment portion 45 at the time the PCV valve 10 is inserted in the attachment portion 45. Alternatively, the PCV valve 10 may be pressed into and thus fixed to the attachment portion 45.

In the above-described embodiment, the dimension of the section of the PCV valve 10 between the flow rate regulating portion 18 and the discharge hole 22 in the direction perpendicular to the axis C1 is smaller than the inner diameter of the attachment portion 45. However, the dimension of the aforementioned section may be greater than the inner diameter of the attachment portion 45. In this case, for example, the first unit 11 is inserted into the attachment portion 45 through the space defined by the oil separator 43 and thus fixed to the attachment portion 45. The second unit 21 is then assembled with the first unit 11, which is fixed to the attachment portion 45, from outside the oil separator 43. In this manner, regardless of the dimension of the section between the flow rate regulating portion 18 and the discharge hole 22 greater than the inner diameter of the attachment portion 45, the PCV valve 10 is attached to the attachment portion 45. Even in this case, the stopping portion 16 of the first unit 11 prevents separation of the PCV valve 10 from the attachment portion 45, as in the case of the above-described embodiment.

The attachment portion 45 may be made of soft material such as rubber. In this case, even if the section of the PCV valve 10 between the flow rate regulating portion 18 and the discharge hole 22 has a dimension greater than the inner diameter of the attachment portion 45, the PCV valve 10 is pressed into and thus attached to the attachment portion 45 through the space defined by the oil separator 43.

In the above-described embodiment, the attachment portion 45 has a cylindrical shape extending from the outer wall of the oil separator 43 with the outer wall serving as the proximal end of the attachment portion 45. Instead of this, the attachment portion 45 may be arranged such that the end of the cylinder closer to the oil separator 43 is located in the oil separator 43. In this case, the stopping portion 16 of the PCV valve 10 contacts the proximal end of the attachment portion 45 in the oil separator 43, thus restricting movement of the PCV valve 10 outward with respect to the oil separator 43.

Although the attachment portion 45 has a uniform inner diameter in the above-described embodiment, the shape of the attachment portion 45 is not restricted to this. For example, the attachment portion 45 may be configured to have an inner diameter becoming smaller as the distance from the proximal end 45A increases. Alternatively, a projecting portion may be provided on the inner peripheral surface of the attachment portion 45 to restrict movement of the PCV valve 10 outward with respect to the oil separator 43.

In the above-described embodiment, the circumference of the flow rate regulating portion 18 is entirely surrounded by the attachment portion 45. However, the flow rate regulating portion 18 may be arranged such that the flow rate regulating portion 18 is partly surrounded by the attachment portion 45. As long as the flow rate regulating portion 18 is partly surrounded by the attachment portion 45, deformation of the surrounded section is limited.

In the PCV valve 10 of the above-described embodiment, the O-ring 26 is attached to the section closer to the inflow hole 12 than the external thread portion 17. However, the O-ring 26 may be attached to the section closer to the discharge hole 22 than the external thread portion 17.

In the above-described embodiment, the PCV valve 10 includes the stopping portion 16 having a shape of a regular octagonal prism. However, the shape of the stopping portion 16 is not restricted to this. The stopping portion 16 may have a shape of a polygonal prism such as a hexagonal prism or a circular column having a diameter greater than the inner diameter R1. That is, the stopping portion 16 may have any suitable shape as long as the stopping portion 16 has a width greater than the inner diameter of the attachment portion 45 in the direction perpendicular to the axis C1 and thus restricts movement of the PCV valve 10 outward with respect to the oil separator 43.

If the stopping portion 16 has a shape of a polygonal prism or a circular column, the width of the stopping portion 16 is greater than the inner diameter of the attachment portion 45 throughout the circumference of the stopping portion 16. The stopping portion 16 may be replaced by multiple projections each having a width greater than the inner diameter of the attachment portion 45. That is, the multiple projections are aligned in the circumferential direction to provide partial stopping portions each having a size greater than the inner diameter of the attachment portion 45. In this manner, movement of the PCV valve 10 outward with respect to the oil separator 43 is restricted.

In the above-described embodiment, a part of the outer wall of the head cover 98 constitutes the wall of the oil separator 43. However, the oil separator 43 may be attached to the outer wall of the head cover 98 or accommodated in the head cover 98.

The configurations of the internal combustion engine 90 and the blow-by gas treating device 30 are illustrated by way of example in the above-described embodiment and thus may be changed as needed. For example, although the oil separator 43 is disposed in the head cover 98 in the embodiment, the oil separator 43 may be attached to the cylinder block 91. As long as the PCV valve 10 is attached to the oil separator 43, the same advantages as those of the embodiment are achieved.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A blow-by gas treating device comprising:

an oil separator that separates oil from blow-by gas;

a connecting pipe that connects the oil separator to an intake passage of an internal combustion engine;

a PCV valve that selectively opens and closes the connecting pipe; and a blow-by gas passage that releases blow-by gas from inside a crankcase to the intake passage, wherein the oil separator has a discharge port as an outlet port for the blow-by gas, wherein a tubular attachment portion in which the PCV valve is inserted is disposed at the discharge port, the PCV valve includes a housing, the housing being a separate body from the oil separator and including an inflow hole into which the blow-by gas flows, a discharge hole from which the blow-by gas is discharged, a flow rate regulating portion having a cross-sectional flow area that is changed through movement of a valve member, and a stopping portion extending radially outward from the housing and located closer to the inflow hole than to the flow rate regulating portion, wherein the stopping portion has a dimension greater than an inner diameter of the attachment portion in a direction perpendicular to a central axis of the attachment portion, the flow rate regulating portion is surrounded by the attachment portion, an end of the connecting pipe corresponding to the oil separator is attached to a section of the PCV valve between the flow rate regulating portion and the discharge hole, and the stopping portion is arranged in a space defined by the oil separator.

2. The blow-by gas treating device according to claim 1, wherein the flow rate regulating portion is surrounded by the attachment portion from one end to the other in the direction along the central axis of the attachment portion.

3. The blow-by gas treating device according to claim 1, wherein the PCV valve is fastened to the attachment portion, and the stopping portion contacts an inner wall of the oil separator.

4. The blow-by gas treating device according to claim 1, wherein the section of the PCV valve between the flow rate regulating portion and the discharge hole has a dimension smaller than the inner diameter of the attachment portion in the direction perpendicular to the central axis of the attachment portion.

5. The blow-by gas treating device according to claim 1, wherein the PCV valve is configured by combining a first unit that has the flow rate regulating portion and accommodates the valve member with a second unit to which the connecting pipe is attached.

6. The blow-by gas treating device according to claim 1, wherein the stopping portion includes a surface, which faces a portion of an inner wall of the oil separator that is located around the discharge port.

7. The blow-by gas treating device according to claim 6, wherein the surface of the stopping portion is in surface-contact with the portion of the inner wall of the oil separator that is located around the discharge port.

* * * * *